United States Patent [19]

Card et al.

[11] Patent Number: 4,665,845

[45] Date of Patent: May 19, 1987

[54] HIGH SPEED TUFTING MACHINE

[75] Inventors: Roy T. Card; Joseph L. Card, both of Chattanooga, Tenn.

[73] Assignee: Card-Monroe Corporation, Chattanooga, Tenn.

[21] Appl. No.: 825,474

[22] Filed: Feb. 3, 1986

Related U.S. Application Data

[63] Continuation of Ser. No. 781,673, Sep. 30, 1985, Pat. No. 4,506,445.

[51] Int. Cl.[4] ..... D05C 15/10

[52] U.S. Cl. ..... 112/80.4; 112/221

[58] Field of Search ..... 112/79 R, 220, 221; 74/44

[56] References Cited

U.S. PATENT DOCUMENTS 812,190 2/1906 Dowen ..... 74/44

3,460,498 8/1969 Eguchi et al. ..... 112/221

4,419,944 12/1983 Passons et al. ..... 112/79 R 4,485,752 12/1984 Slomma et al. ..... 112/79 A X 4,515,096 5/1985 Ingram ..... 112/79 R

*Primary Examiner*—Ronald Feldbaum

*Attorney, Agent, or Firm*—Newton, Hopkins & Ormsby

[57] ABSTRACT

The head of a tufting machine frame journals a plurality of transversely spaced push rods, the lower end of which carries a needle bar and its needles. The upper end of each push rod has an individual drive assembly which includes a sidewise extending drive pin pivotally connected to a connecting rod reciprocated by an eccentrically mounted pivot pin protruding from the face of a crank member which is removeably mounted on a driven wheel carried by a stub shaft. A timing belt, connected over the driven sprocket, is itself driven by one of a plurality of drive wheels on a main drive shaft.

7 Claims, 3 Drawing Figures

HIGH SPEED TUFTING MACHINE

REFERENCE TO RELATED APPLICATION

This is a continuation of application Ser. No. 781,673, filed Sept. 30, 1985, now U.S. Pat. No. 4,506,445.

BRIEF SUMMARY OF THE INVENTION

This invention relates to tufting machines and is more particularly concerned with a high speed tufting machine.

In the past, there has been a continuous effort to increase the production capacity of a tufting machine by increasing its speed of operation. At the present time tufting machines can operate at about 750 rpm and in some instances at speeds greater than 1000 rpm. The speed of the machines which have a mechanism for altering the stroke of the needle bar is limited because of the bulk and construction of the mechanism.

The present invention, by providing an improved needle bar reciprocating mechanism, will increase the speed of an otherwise conventional tufting machine by about 30% thereby providing speeds in the neighborhood of 1320 rpm and higher.

Briefly described, the present invention includes a conventional multi-needle tufting machine in which the needle bar reciprocating mechanism contained in the head of the machine includes a straight transversely extending main drive shaft rotated in a conventional manner at a prescribed speed of rotation. At spaced intervals along the length of the drive shaft are concentrically mounted circular timing driving sheaves, pulley or sprockets, each of which is keyed to the main drive shaft.

Each driving sheave drives, through a continuous timing belt, a gear pulley, sheave or sprocket on a crank member support stub shaft. The gear pulley carries a removeable stroke cam or crank member from which protrudes a pin. The pin is pivotally received on one end of a connecting rod, the other end of which drives one of the push rods which support and reciprocate the needle bar. By changing the stroke cams, the stroke of the needle bar is changed.

Accordingly, it is an object of this invention to provide a tufting machine which is inexpensive to manufacture, durable in structure and efficient in operation.

Another object of the present invention is to provide a tufting machine which will operate at extremely high speeds.

Another object of the present invention is to provide a tufting machine which has a needle bar drive mechanism which is well balanced and which reduces the vibration and friction generated by the tufting machine when operated at high speeds.

Another object of the invention is to provide a tufting machine in which the stroke of the needle bar may be readily and easily altered.

Another object of the present invention is to provide a tufting machine in which the stroke of the needle bar can be readily and easily changed while maintaining essentially the same bottom dead center position, of the needlebar, thereby positioning the needles in proper relationship to the loopers for the loop engaging activities of the loopers.

Another object of the present invention is to provide in a tufting machine a needle bar reciprocating mechanism which will reduce the weight and size of the mechanism and reduce the bearing surfaces.

Another object of the present invention is to provide a tufting machine in which the overdrive of the needles when driven at high speed will be reduced to a minimum.

Another object of the present invention is to provide a tufting machine in which the worn parts of the needle bar reciprocating mechanism can be readily and easily replaced and in which the driving and timing mechanism can be readily regulated.

Another object of the present invention is to provide a tufting machine in which the shock of the needles in penetrating the backing material will be more easily absorbed by the machine.

Another object of the present invention is to provide a tufting machine in which all parts of the needle bar drive assembly can be readily and easily replaced.

Another object of the present invention is to provide a tufting machine capable of being operated in the neighborhood of 1500 rpm.

Another object of the present invention is to provide a tufting machine which generates less noise and heat than a conventional tufting machine.

Other objects, features and advantages of the present invention will become apparent from the following description when taken in conjunction with the accompanying drawings wherein like characters of reference designate corresponding parts throughout the several views.

DETAILED DESCRIPTION

Figure 1:
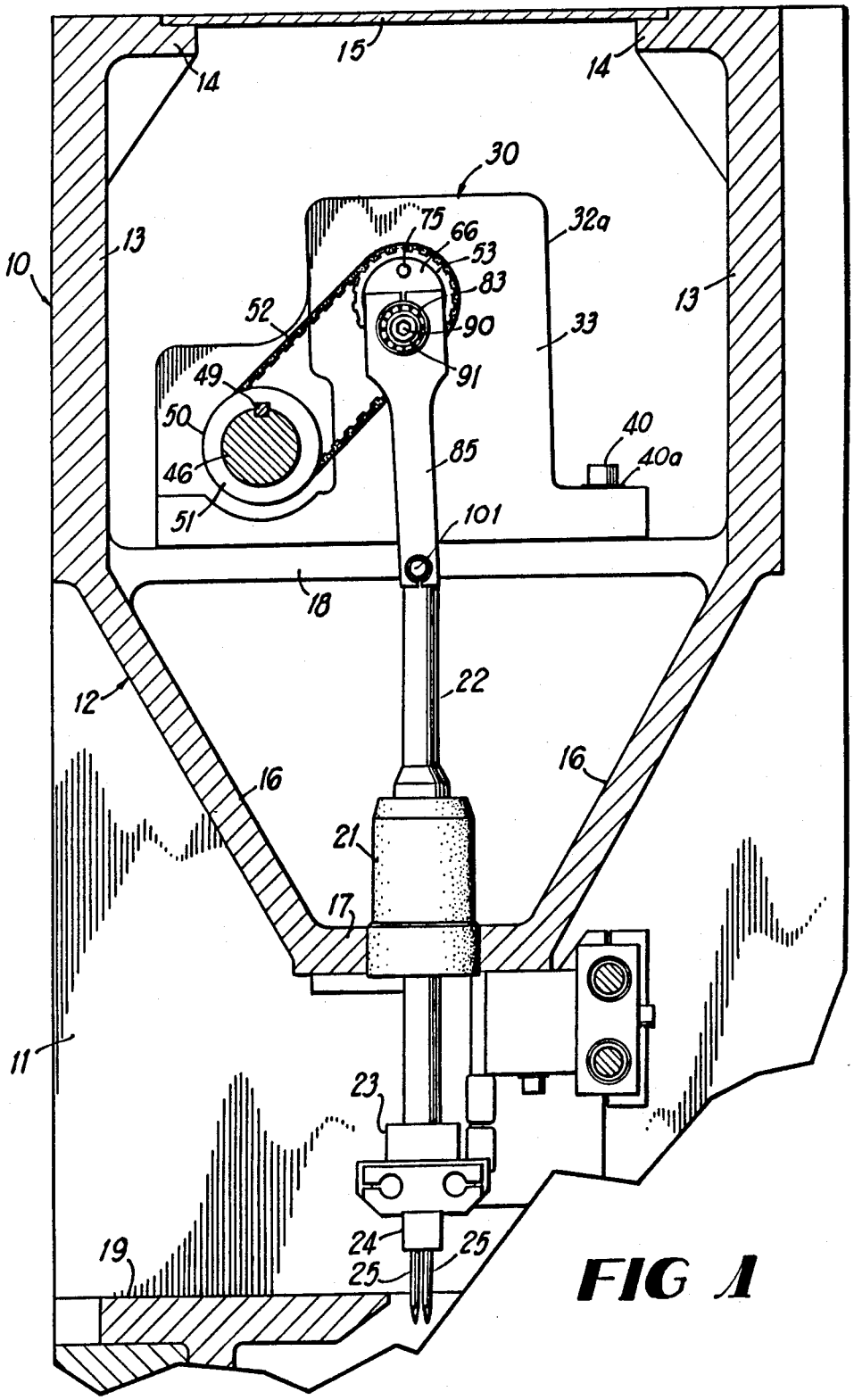
FIG. 1 is vertical sectional view of the upper portion of a tufting machine constructed in accordance with the present invention.
Figure 2:
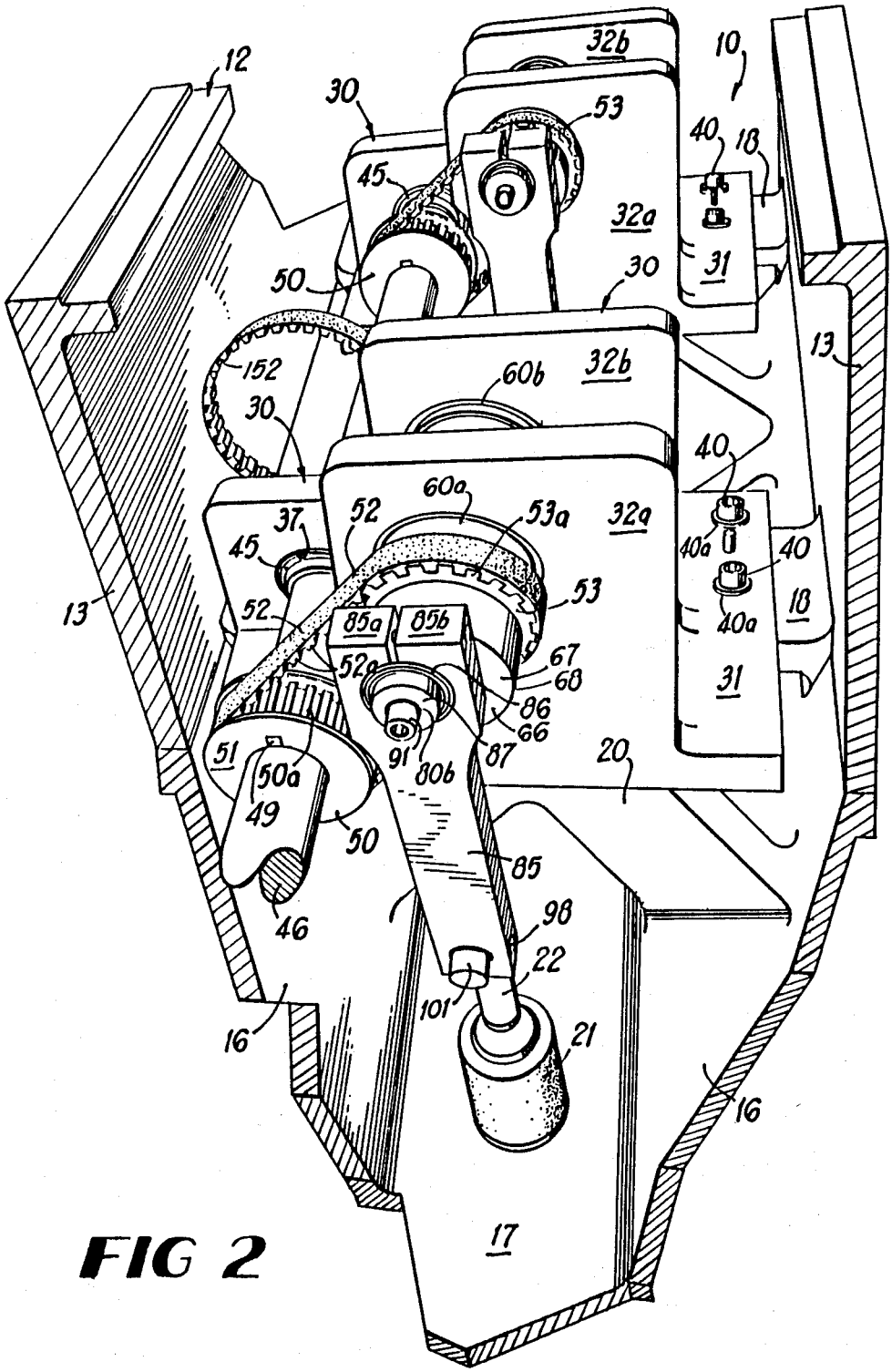
FIG. 2 is a fragmentary perspective view of a portion of the tufting machine depicted in FIG. 1.

Referring now in detail to the embodiment chosen for the purpose of illustrating the present invention, numeral 10 in FIGS. 1 and 2 denotes generally a conventional tufting machine having a conventional frame 11 with a base or bed plate 19 which extends transversely across the machine. The tufting machine also includes a head 12 which extends transversely across the machine above the bed plate 12. The head 12 has a pair of opposed vertically disposed spaced parallel sides 13 having upper flanges 14 which support a cover plate 15. A pair of downwardly converging lower plates 16 support by their lower edges a horizontally extending bottom plate 17. Spaced above and parallel to the bottom plate 17 are a plurality of transversely spaced longitudinally extending cross-plates 18 which extend from the bottom portion of one of the side plates 13 to the bottom portion of the other side plate 13. If desired, A-frames, such as A-frame 20 seen in FIG. 2 can extend up from central portions of the lower plates 16 to the bottom central portions, respectively, of the cross-plates 18. Centrally aligned and transversely spaced from each other are a plurality of journal members, such as journal member 21, which respectively slideably retain the push rods, such as push rod 22. Usually there are about nine of these push rods 22 in a four meter tufting machine. The end portions of these push rods 22 are externally of the head 12 and carry support blocks, such as support block 23 which, in turn, support a transversely extending needle bar 24. Needles 25 protrude downwardly from the needle bar 24 in one or more transverse rows extend across the tufting machine and these needles 25 are reciprocated in a vertical path for inserting yarn (not shown) through the backing material (not shown).

It will be understood by those skilled in the art that there are loopers (not shown) disposed below the bed plate 19 for engaging and holding the yarns inserted through the backing material, each time the needles 25 penetrate the backing material. These loopers are at a fixed height to and usually protrude through the loops sewn by the needles, when the needles 25 are at approximately bottom dead center. Thus, it is desirable that the bottom dead center positions of all needles 25 remain the same, regardless of the length of the stroke of the tufting machine. Of course, as is well known, the bed plate 19 can be raised or lowered to prescribe the depth of penetration of the needles 25 through the backing material.

The structure and functions described above are conventional and therefore a more detailed disclosure of the same is not deemed necessary.

According the the present invention, there are disposed within the head 12, individual shaft support members, denoted generally by the numeral 30 which are respectivelly above and slightly offset from inner ends of the push rods, each shaft support member 30 including a rectangular base having a flat bottom surface which is carried by and on a cross plate 18 and a pair of spaced upstanding parallel longitudinally extending bearing plates **32*a* and 32*b*. The main bearing plate 32*a* has a flat outer surface 33 which is in a common plane with the outer side 34 of the base 31. The auxilliary bearing plate 32*b* is mounted generally centrally of the base 31 and is reinforced by a fillet 35. The bearing plates 32*a* and 32*b* are respectively provided with transversely aligned bearing receiving holes 36*a* and 36*b* which have a common axis which extends in a transverse direction. The bearing plate 32*b* is longer at its lower portion so as to define a bearing receiving hole 37 provided with a transverse axis which is below and rearwardly of the transverse axis. Concentric with the hole 37 is a concaved upwardly opening recess 38 in the base 31**.

Machine screws, such as machine screws 40, passing through washers **40*a* and holes, such as holes 41, in the base 31 mount each of the bases 31 on its associated cross plate 18, as illustrated in FIG. 2, so that the base protrudes in cantilever fashion toward the axis of the push rod 22 with which the bearing block 31** is associated.

Figure 3:
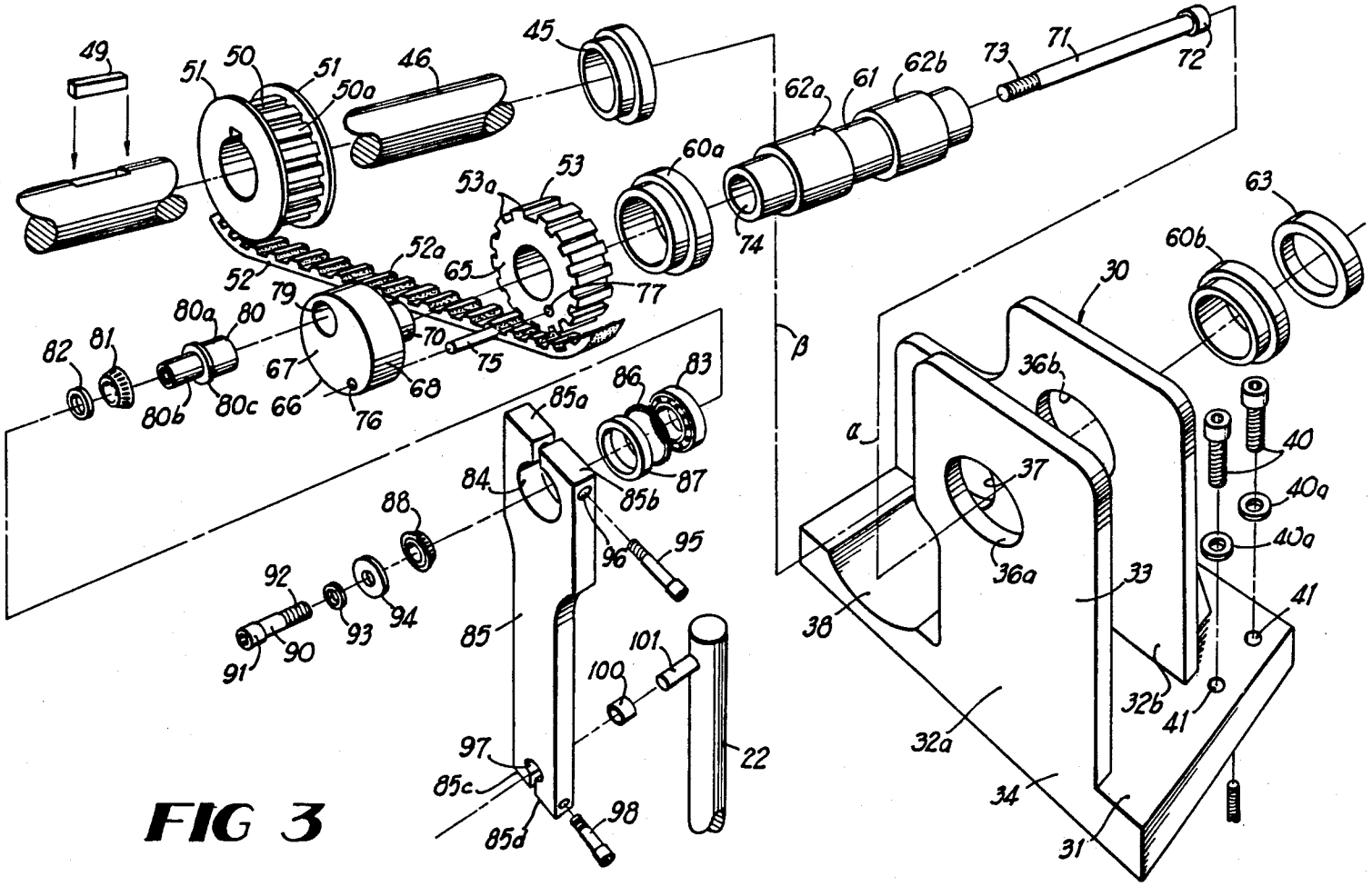
FIG. 3 is an exploded perspective view of the needle bar drive assembly of the machine depicted in FIGS. 1 and 2.

Press fitted in each of the holes 37 is a main bearing such as bearing 45, as seen in FIGS. 2 and 3.

When all of the shaft support members 30 are mounted on the machine, the holes **36*a* and 36*b* of all of the shaft support members will be in transverse alignment along axis and all of the holes 37 will be in transverse alignment along axis which is parallel to and spaced from axis. Bearings 45 in the holes 37 journals a main drive shaft 46. An electric motor (not shown), externally on the housing 11 conventionally rotates the main shaft 46**.

The main drive shaft 46 drives a plurality of identical gear trains, each of which is identical, the gear trains respectively driving the push rods 22.

At spaced intervals along the length of the main drive shaft 46 are the drive wheels, for the respective gear trains such as the main shaft timing sheaves, pulleys or sprockets 50. Each main timing sheave 50, is provided with a plurality of teeth or sprockets **50*a* along its periphery and is provided with opposed annular guide plates such as plate 51. The teeth 50*a* of sprockets 50 mesh with the teeth 52*a* of sprockets 52 of a continuous flexible timing belt 52. The flanges or guides 50*b* of sheave 50 are disposed on opposite sides of the belt 52 and therefore prevent the belt 52 from traveling sidewise off of the sheave 50. Each belt 52 passes around and drives a driven wheel such as a gear pulley or sheave or sprocket 53, the teeth 53*a* of which mesh with the teeth 52*a*. Sheaves 50 and 53 are of the same diameter and have the same number of peripheral teeth 50*a* and 53*a*. Therefore, all gear pulleys 53 are rotated at the same rate of speed as the rotation of shaft 46 and are synchronized, at all times with the rotation of shaft 46. Keys, such as key 49 connected between the shaft 46 and the sheaves 50, lock the rotation of sheaves 50 to shaft 46. There are no flanges on the gear pulley 53 so that the belt 52 can be removed without appreciably stretching the belt 52**.

Press fitted into the holes **36*a* and 36*b* of each support member 30 are a pair of bushings or bearings 60*a* and 60*b*, seen best in FIG. 3. A crank member support shaft, such as hollow tubular stub shaft 61, is journalled by each pair of bearings 60*a* and 60*b* and is provided with spaced peripheral bearing surfaces 62*a* and 62*b* which are respectively received by the bearings 60*a* and 60*b*. The end of each stub shaft 61 protrudes in counterlever fashion outwardly from the bracket plate 32*a* and receives, press fitted by its central opening 53*b*, the gear pulley 53. Thus, the stub shaft 61 rotates with the gear pulley or driven wheel 53, the bearing surfaces 62*a* and 62*b* bearing against the bearings 60*a* and 60*b*. All stub shafts 61 are in transverse alignment along a common axis $\alpha$ parallel to and offset from axis $\beta$ of shaft 46**.

A lock ring 63 fits onto the end of stub shaft 61 and is carried for rotation with the gear pulley 53.

Mounted flush against the flat radial outer surface 65 of the gear pulley 53 is a crank member or stroke cam 66. This stroke cam 66 has flat radial inner and outer surfaces, such as surface 67 and a cylindrical outer periphery 68. Protruding inwardly from the central portion of the stroke cam 66 is an internally threaded mounting hub 70 which is slideably received in the central opening 74 of shaft 61. A draw bolt 71, having a head 72 at one end and external threads 73 at its other end, passes through the hollow opening 74 of the stub shaft 61 and is threadedly received by threads 73 in the end portion of the hub 70 so as to clamp the crank member or stroke cam 66 firmly against surface 65 of the gear pulley 53. A dowel pin, or shear pin 75, which passed through a hole 76 in the stroke cam 66 and into a hole 77 in the gear pulley locks the stroke cam 66 and the gear pulley 53 together for simultaneous rotation, the crank member or stroke cam 66 being flat or flush against gear pulley 53.

As best seen in FIG. 3, the outer surface 67 of the stroke cam 66 is provided with an eccentrically disposed hole 79 which receives, press fitted therein, the larger diameter end portion **80*a* of a stroke cam pin or crank pivot pin 80. The axis $\gamma$ of pin 80 is parallel to and offset from axis and perpendicular to the axis of its push rods 22. This stroke cam pin 80 has a smaller diameter outwardly protruding portion, denoted by numeral 80*b*, separated from the portion 80***a* by circumferential collar 80*c*. This smaller portion 80*b* protrudes outwardly from the flat radial surface 67 and receives thereon a cone bearing 81 and a bearing spacer 82, the bearing 81 forming the inner race which is received in an outer race 83 clamped into an upper hole 84 of a connecting link or rod 85. The bearing arrangement also includes a central cup or spacer 86 and a second outer race 87 which receives the inner race of a cone bearing 88 fitted into the race 87 from the opposite side of the connecting link or rod 85. A bolt 90, having a head 91 and at one end and external threads 92 at its other end, passes through a pair of washers 93 and 94 and into the threaded end of the outer portion 80*b* of the pin 80, thereby urgng the cone shaped bearing 88 and the cone shaped bearing 81, from opposite sides against their respective races 87 and 83.

It will be observed in FIG. 3 that the upper end portion of the connecting rod 85 is bifrocated above the upper hole 84 so that the bifrocated end portions or legs 85*a* and 85*b* are spaced apart. A bolt 95 passing sidewise through a hole 96 in one of the bifrocated legs 85*a* and 85*b* is received in the other leg thereof and when tightened, firmly clamps the outer races 83 and 87 within the hole 84. Since the washer 94 urges the inner race 88 inwardly and thr shoulder 80*c* urges the inner race 81 inwardly, the upper end portion of the connecting rod 85 is quite firmly clamped onto the pin 80 and yet is freely rotatable thereon. The body of connecting rod 85 has parallel flat inner and outer surfaces which are parallel to the flat surface 67 of the crank member or stroke cam 66.

The lower end portion of the connecting rod or link 85 is also bifrocated to provide legs 85*c* and 85*d* which are spaced apart, above a circular opening 97. A set screw or bolt 98 passes sidewise through the leg 85*b* and is threadedly received in the leg 85*c* clamps a bushing 100 in the hole 97. This bushing 100 journals a sidewise extending push rod pin 101 which protrudes radially from the upper end portion of the push rod 22. The pin 101 is parallel to and protrudes in the same transverse direction as the shaft 61 and pivot pin 80 and freely rotatable in the bushing 100 and can be moved axially so that the lower end portion of the connecting link or rod 85 can be readily removed when the link or rod 85 is moved sidewise away from the connecting rod 22. Since the connecting rod 22 is firmly journalled for axial movement by the bearing 21, the pin 101 remains in its bushing 100 so long as the upper bearing assembly of the connecting rod or link 85 is retained on the pin 80. All pins 80 are in transverse alignment and all pins 101 are in transverse alignment.

Upon rotation of the main drive shaft 46, all belts 52 will be driven simultaneously so that all gear pulleys 53 will likewise be rotated simultaneously. Hence, through the gear train described above, all push rods 22 will be reciprocated simultaneously, for reciprocating the needles 25. Of course, the speed of rotation of shaft 46 will determine the speed of reciprocation of needles 25; however, if desired, sprockets or gear pulleys 53 can be changed to change the drive ratio. Preferably the drive ratio is 1:1.

It will be seen in FIG. 2 that an extra belt 152 can be draped over the shaft 46, to be available in the event that the belt 53 becomes worn. Also, different size belts (not shown) can be disposed for later use, if necessary.

An important feature of the present is the fact that the stroke of the push rods 22 can be readily and easily altered, without substantial dismanteling of the tufting machine. This is accomplished by lossening the bolts 90, 95 and 98 and removing bolt 71, to thereby permit the removal of the connecting rod 85 and the stroke cam 66 with its pin 80. Indeed, since the bushing 100 will slide with respect to the radial pin 101, only the bolt 71 need be taken off in order to remove, as a unit, the stroke cam 67, its pin 80, the bearings 83–88 and the piston rod 85, as a unit. In replacing the piston rod 85 and the stroke cam 66 with its pin 80, the increase in stroke of the needle bar 24 is dictated by the distance between the axis $\alpha$ or center of the stroke cam 66 and the center or axis $\gamma$ of the pin 80.

When this stroke is decreased or increased, an appropriately longer or shorter connecting rod 85 is required so that bottom dead center of the needles 25 will remain the same and thus be appropriately positioned for action by the loopers (not shown). The length of the stroke of needles 25 can be altered as much as desired, within the capability of the machine and all adjustment of the stroke will be upwardly, while the needles 25, in all instances reach bottom dead center at their prescribed positions. The average stroke of a tufting machine is between about $1\frac{1}{2}$ inches to about $1\frac{3}{4}$ inches on a carpet machine. When a short needle stroke ($1\frac{1}{8}$ inch total stroke) the machine can run at about 1500 rpms.

The spaces between the respective drive assemblies which drive each push rod 22 is sufficient that access can readily be had to remove and install different length connecting rods 85. The fact that no tool is required for removing the connecting rod from pin 101, means that most work is carried on at the top portion of head 12.

When any of the bearings in the needle bar drive assembly become worn, it is a relatively simple manner to disassemble that part of the drive train involved, without the necessity of removing the main shaft 46.

The connecting rod 85 and its pin 80 being relatively light weight, and the stroke cam 66 and gear pulley 53 being concentric and also being light weight, the tufting machine runs quite smoothly without appreciable vibration. Furthermore, a more uniform stroke is achieved utilizing the structure of the present invention than prior art adjustable stroke machines.

The dynamic balance of the present machine permits a relatively high speed to be attained and speeds of 1000 rpm to about 1320 rpm are commonly achieved in production, utilizing the present machine. Indeed speeds in excess of 1300 rpm are attainable as pointed out above. This is an increase of about 33% in the speed of a tufting machine.

It takes about 30 minutes of down time to make a change in stroke of the present tufting machine whereas, previously it required substantially more down time to make the adjustment on prior art adjustable stroke machines.

It will be apparent that the needle bar drive assembly of the present invention is lighter in weight than conventional drive assemblies with adjustable stroke and has less bearing surfaces which frictionally engage each other. This results in a more uniform stroke, less generation of heat from the machine parts and less noise.

In the event of unusual shock transmitted to the push rods 22, this shock will be taken up by the resiliency of the belts 52 and, indeed, the pins 75 can shear, rather than have the shock, damage any of the other parts.

Since pins 101 can readily move axially within busing 100, vibrations transmitted from the needle bar, through push rods 24, will tend to be discipated.

The utilization of the belts 52 is another important feature of the present invention since in our earlier attempts to reduce the weight of the needle bar drive assembly, we have found that a gear to gear drive from the shaft 46 to shaft 61 is not as desirable as the belt drive arrangement herein depicted.

It will be obvious to those skilled in the art that many variations may be made in the embodiment here chosen for the purpose of illustrating the best mode of carrying out the present invention, without departing from the scope thereof as defined by the appended claims.

We claim:

1. Process of tufting wherein a needle bar, carried by piston rods holding a plurality of needles carrying yarns, repeatedly inserts the needles and yarns simultaneously into backing material to form successive rows of loops of said yarns in said backing material and wherein the needle bar is supported and reciprocated by a plurality of spaced piston rods which, in turn, are reciprocated by spaced individual crank members; and wherein the improvement comprises the follows steps:

(a) supporting said crank members for rotation about a fixed common axis;

(b) driving said individual crank member by a like number of endless flexible members; and (c) driving said flexible members from a common drive shaft to thereby reciprocate said piston rods in synchronization with each other.

2. The process defined in claim 1 wherein the step of driving said flexible members include:

(a) disposing a drive shaft generally parallel to said needle bar and adjacent to said crank member:

(b) fixing a plurality of axially spaced wheels on said shaft for rotation by said shaft; and (c) respectively driving said flexible members from said wheels.

3. A tufting machine of the type having a frame provided with a head, a plurality of space push rods extending to said head along spaced parallel axes and a needle bar carried by the ends of said push rods externally of said head, the improvement comprising:

a plurality of crank members respectively disposed within said head adjacent to the inner ends of said push rods, push rod pins respectively protruding in counterlever fashion sidewise from said push rods, drive pins protruding respectively in counterlever fashion sidewise from said crank members, connecting rods, each of which journals, by one of its end portions a push rod pin and journals, by the other of its end portions, a drive pin, each of said connecting rods being removeable sidewise from its associated push rod pin and drive pin, means for supporting for rotation said crank members, and means from imparting rotation to said crank members.

4. The tufting machine defined in claim 3 including means removeable from said drive pins for retaining said connecting rods thereon.

5. The tufting machine defined in claim 3 wherein said means for supporting for rotation said crank members includes an individual support shaft for each crank member, journal means for supporting each support shaft for rotation, said support shaft protruding sidewise from said journal means and said crank member being connected to the end of its associated support shaft.

6. The tufting machine defined in claim 5 wherein said journal means are supported by said head and spaced from each other support so that the end of one support shaft is spaced from the crank member of the next adjacent support shaft.

7. The tufting machine defined in claim 3 wherein said support members are supported by said head and are spaced from each other and including support shafts aligned with each other along a common axis and respectively supporting said crank members, the end of one support shaft is spaced from the crank member supported by the next adjacent support shaft.

* * * * *